United States Patent [19]

Nusser

[11] Patent Number: 4,971,530

[45] Date of Patent: Nov. 20, 1990

[54] AGGREGATE FOR FEEDING FUEL FROM SUPPLY TANK TO INTERNAL COMBUSTION ENGINE

[75] Inventor: Hermann Nusser, Markgroeningen, Fed. Rep. of Germany

[73] Assignee: Robert Bosch GmbH, Stuttgart, Fed. Rep. of Germany

[21] Appl. No.: 417,873

[22] Filed: Oct. 6, 1989

[30] Foreign Application Priority Data

Jan. 7, 1989 [DE] Fed. Rep. of Germany ..... 3900264

[51] Int. Cl.[5] ..... F04B 17/00

[52] U.S. Cl. ..... 417/360; 417/366

[58] Field of Search ..... 417/360, 366; 418/171

[56] References Cited

U.S. PATENT DOCUMENTS

| | | | |
|---|---|---|---|
| 4,181,473 | 1/1980 | Ina | 417/366 X |
| 4,209,284 | 6/1980 | Lochmann et al. | 417/366 |
| 4,231,718 | 11/1980 | Ruhl et al. | 417/366 |
| 4,370,102 | 1/1983 | Sasaki et al. | 417/366 X |
| 4,447,192 | 5/1984 | Tuckey | 417/360 |
| 4,566,866 | 1/1986 | Kemmner | 417/366 |
| 4,580,951 | 4/1986 | Carleton et al. | 417/366 |
| 4,626,178 | 12/1986 | Terumoto | 417/366 |
| 4,629,399 | 12/1986 | Friebe | 417/201 |
| 4,662,827 | 5/1987 | Wiernicki | 417/366 X |
| 4,718,827 | 1/1988 | Sutton et al. | 417/360 X |

*Primary Examiner*—John Rivell

*Attorney, Agent, or Firm*—Michael J. Striker

[57] ABSTRACT

An aggregate for feeding a fuel from a supply tank to an internal combustion engine, particularly a power vehicle comprises an electric drive motor, a feeding pump driven by the drive motor, a housing accommodating the drive motor and the feeding pump and having two openings, two covers each covering a respective one of the openings, and a spacer extending from one of the covers to another of the covers and connecting the covers with one another so as to form a one-piece integral structure.

3 Claims, 3 Drawing Sheets

AGGREGATE FOR FEEDING FUEL FROM SUPPLY TANK TO INTERNAL COMBUSTION ENGINE

BACKGROUND OF THE INVENTION

The present invention relates to a feeding aggregate for feeding fuel from a supply tank to an internal combustion engine. More particularly, it relates to such an aggregate which has an electric drive motor, a pump driven by the electric drive motor, a housing accommodating both elements and having an opening closed with a cover.

Feeding aggregates of the above mentioned general type are known in the art. One of such feeding aggregates is disclosed, for example, in U.S. Pat. No. 4,629,399. In this feeding aggregate both covers are held at a predetermined distance from one another by pole tube of the electric motor. This arrangement is then accommodated in a special housing tube. Its both ends must be drilled through outer end faces of both covers to provide a stable connection of all parts. In addition to special working steps, the mounting of respective aggregate parts must be performed inside the pole tube. This is difficult, time consuming and thereby expensive.

SUMMARY OF THE INVENTION

Accordingly, it is an object of the present invention to provide a feeding aggregate of the above mentioned general type, which avoids the disadvantages of the prior art.

More particularly, it is an object of the present invention to provide a feeding aggregate of the above mentioned type, in which both covers together with a distance holder or spacer produce an open mounting frame which is accessible from all sides and can be easily premounted. The mounting of the pole tube, simultaneously the mounting of the housing can be performed, which considerably simplifies the assembly of the feeding aggregate.

In keeping with these objects and with others which will become apparent hereinafter, one feature of the present invention resides, briefly stated, in a feeding aggregate of the above mentioned type in which both covers are connected with one another by a one-piece spacer extending from one cover to another cover to form a one-piece integral structure.

When the feeding aggregate is designed in accordance with the present invention it avoids the disadvantages of the prior art and achieves the above specified objects.

In accordance with another feature of the present invention, both covers are arranged in a tubular housing, and the spacer extends inside the housing part.

Still another feature of the present invention, is that one of the covers has a radial ring projection which cooperates as an abutment with a ring end surface of the tubular housing part. 5 A further feature of the present invention, is that the spacer is formed by two braces located opposite to one another relative to an axis of rotation of the drive motor.

The electric drive motor can have a return closure pipe and two permanent magnets arranged on it, wherein the tubular housing part forms the above mentioned return closure pipe.

Both braces can extend between ends of permanent magnets which face toward one another and are spaced at a distance from one another.

At least one of the two braces has at least one elastically pre-tensioned region as considered in the peripheral direction of the pole tube, which presses against the facing side surface of one of the permanent magnets.

The elastically pre-tensioned region can be provided in both braces and pressing against associated side surfaces of the permanent magnets.

Both braces at their sides adjacent to the permanent magnets can have openings which are determined by the width of the magnets for receiving the ends of the permanent magnets.

Finally, the other cover at its end surface facing away from the ring projection, can be provided with an elastically deformable safety element engaging with another ring end surface of the tubular housing part at least locally.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
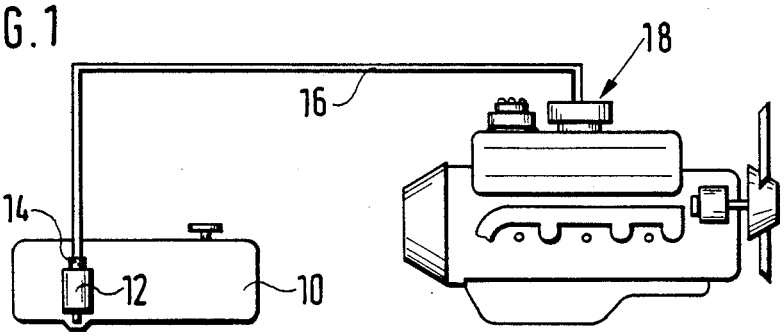
FIG. 1 is a view showing schematically an arrangement for feeding fuel for power vehicles.

FIG. 1 shows a supply tank 10 in which a fuel feeding aggregate 12 is arranged. The fuel feeding aggregate 12 has a pressure pipe 14 connected with a pressure conduit 16 which leads to an internal combustion engine 18. During the operation of the internal combustion engine the fuel feeding aggregate 12 feeds fuel from the supply tank 10 to the internal combustion engine 18.

Figure 2:
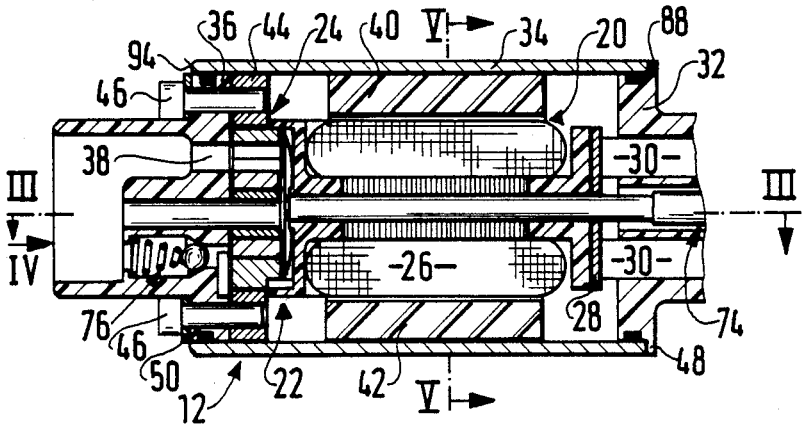
FIG. 2 is a view showing a longitudinal section of a feeding aggregate in accordance with the present invention.

FIG. 2 shows the construction of the fuel feeding aggregate 12. It has an electric drive motor 20 which is driven through a coupling means 22 of a fuel feeding pump 24. In the shown embodiment the feeding pump 24 is formed as a so-called inner teeth gear pump. The electric drive motor has an armature 26 with a so-called plane commutator 28, and brushes 30 abut against the commutator. The brushes 30 are guided in a cover 32 which also has current guiding conductors for the electric current. The cover 32 closes one end of a tubular housing part 34, while its another opening is closed by another cover 36. The cover 36 has a suction opening 38 leading to the feeding pump 24.

The housing part 34 carries on its inner wall two oppositely arranged permanent magnets 40 and 42 and is composed of a ferromagnetic material. Both covers 36 and 32 are composed of a synthetic plastic material. The housing part 34 forms therefore a so-called return closure and pole pipe for the electric motor 20. A guiding ring 44 of the feeding pump 24 is fixed on the frame and connected through mounting screws 46 fixedly with the cover 36. One cover 32 has a flange-like ring projection 48 which serves as an axial abutment for the return closure pipe 34.

Figure 3:
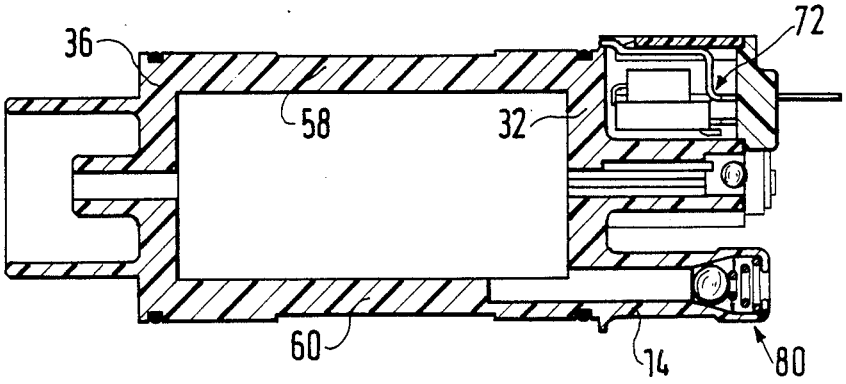
FIG. 3 is a longitudinal section of a mounting unit of the inventive feeding aggregate, taken along the line III—III in FIG. 2.
Figure 4:
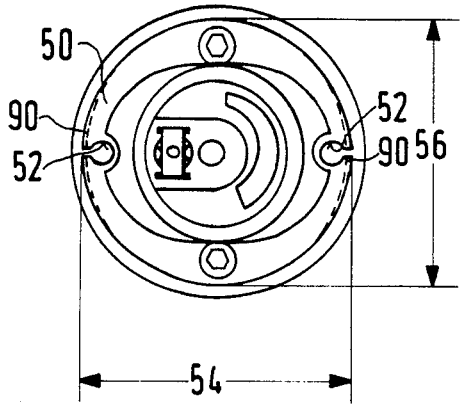
FIG. 4 is a view of the feeding aggregate in accordance with the present invention of FIG. 2 as seen in direction of the arrow IV.
Figure 5:
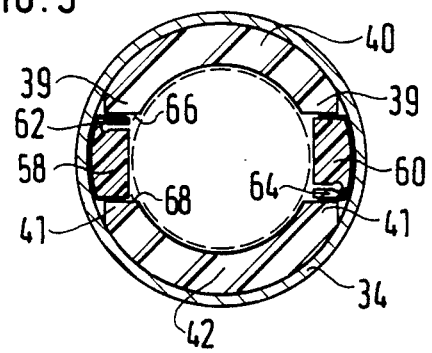
FIG. 5 is a view showing the feeding aggregate of the invention taken along the line V—V in FIG. 2, wherein a motor armature of the feeding aggregate is identified in a broken line.

A disc shaped safety element 50 is held at the end surface of the cover 36 facing away of the ring projection 48, by means of mounting screws 46. It can be deformed through auxiliary openings 52 by a suitable tool so that it reduces its dimension 54 as shown in FIG. 4, so that the safety element 50 can be guided through the opening of the tubular housing 34. Another dimension of the safety element 50 identified as 56 is insignificantly smaller than the opening diameter of the tubular housing 34. As can be seen especially from FIG. 3, both covers 32 and 36 are connected with one another by a spacer in one-piece structure. In the shown embodiment it has two braces 58 and 60. FIG. 5 shows that both braces 58 and 60 extend inside the housing 34. They are connected of one-piece integrally with both covers 32 and 36 as shown in FIG. 3. Both braces 58 and 60 extend in FIG. 5 between a face 39 of the magnet 40 and an end 41 of the magnet 42 facing toward one another, respectively. Each brace 58 or 60 has in this embodiment an elastically prestressed region 62 or 64 in a peripheral direction of the pole pipe 34. This region presses against a facing side surface 66 or 68 of the neighboring permanent magnet 40 or 42. For fixing the permanent magnets 40 and 42 each brace 58 and 60 has two recesses 70 for receiving the ends 39 or 41 of the permanent magnets 40 or 42. The width of the recesses 70 is determined in accordance with the width of the magnets.

Finally, it should be mentioned that the cover 32, as shown in FIG. 3 has suppression elements 72. The cover 32 further has the pressure pipe 14 through which the medium to be fed flows in the pressure or feeding conduit 16. The cover 32 is further provided with a support 74 for the motor armature 26 supported at its one side. The other cover 36 has a pressure control valve 76 in addition to the suction opening 38.

Figure 6:
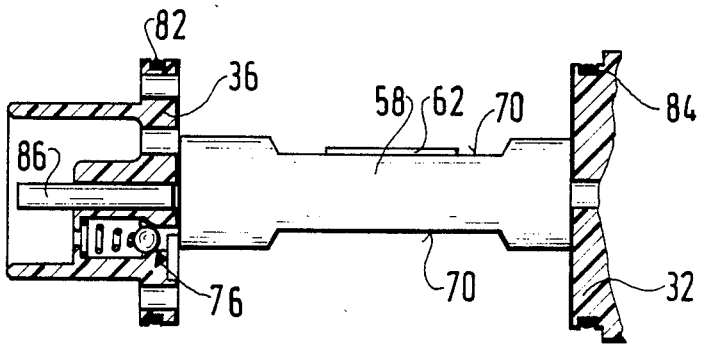
FIGS. 6–9 are views illustrating successive mounting steps for mounting the feeding aggregate in accordance with the present invention.
Figure 7:
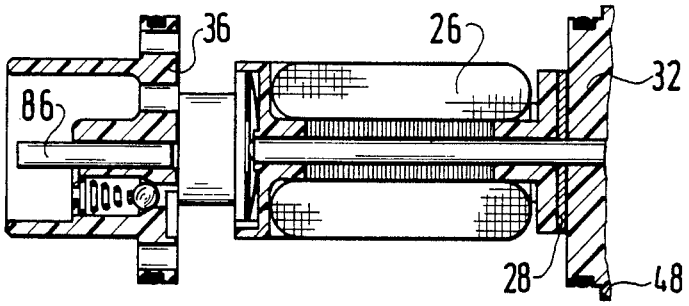
Figure 8:
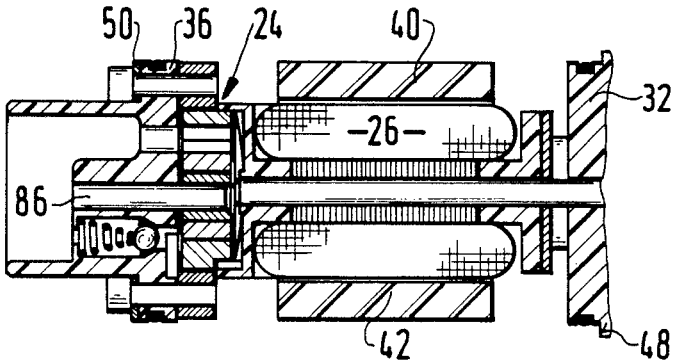
Figure 9:
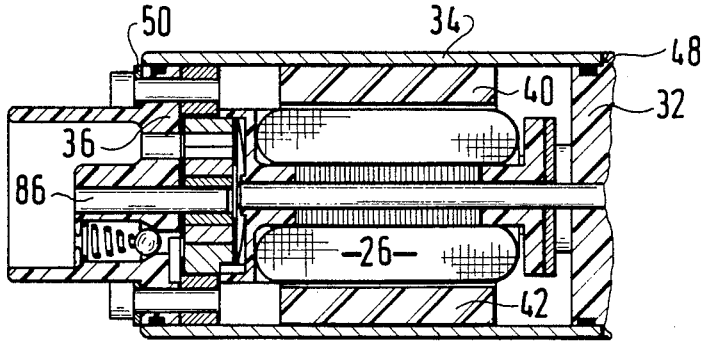

The mounting of the feeding aggregate 12 is shown in FIGS. 6–9. First, a one-part mounting frame composed of two covers 32 and 36 as well as both braces 58 and 60 is pre-mounted, with the pressure control valve 76 and a check valve 80 located in the pressure pipe 14 built in, and the so-called sealing or O-rings 82 and 84 pulled on the covers 32 and 36 as shown in FIGS. 2 and 6. In a further mounting step shown in FIG. 7, the motor armature 26 is mounted, until the plane commutator 28 comes to abutment, against the cover 32. In a next process step which is illustrated in FIG. 8, the feeding pump 24 is mounted, and the electrical connection with the carbon brush 30 and with the electrical current suppression element 72 is mounted as shown in FIG. 3. Further, a bearing pin 86 for the feeding pump 24 premounted in the first process step is pressed in, and the feeding pump 24 is adjusted. Finally, the permanent magnets 40 and 42 are 5 inserted and the elastic regions 62 and 64 are compressed and held under pre-tensioning. First the magnets are magnetized. Then the tubular housing part 34 is displaced till the ring end surface 88 of the housing pipe 34 facing toward the ring projection 48 comes to abutment against the ring projection 48. Both auxiliary openings 52 of the safety element 50 mounted with the feeding pump 24 must be pulled against one another with the aid of the above mentioned tool, so that the disc shaped safety element 50 is elastically deformed and can be pulled through the housing pipe 34. When the mounting position shown in FIG. 9 is achieved, the safety element 50 can be further spring off so that it again assumes its dimension 54. Then both small, sickle-shaped regions 90 of the safety element 50 reach behind the other end ring surface 94 of the tubular housing part 34, so that an operationally safe position of the housing pipe 34 on the mounting frame 32, 36, 58, 60 is achieved as shown in FIG. 4.

It will be understood that each of the elements described above, or two or more together, may also find a useful application in other types of constructions differing from the types described above.

While the invention has been illustrated and described as embodied in an aggregate for feeding fuel from a supply tank to an internal combustion engine, particularly of a power vehicle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An aggregate for feeding a fuel from a supply tank to an internal combustion engine, particularly a power vehicle, comprising an electric drive motor; a feeding pump driven by said drive motor; a housing accommodating said drive motor and said feeding pump and having two openings; two covers each covering a respective one of said openings; and a spacer extending from one of said covers to another of said covers and connecting said covers with one another so as to form a one-piece integral structure, said housing being tubular, said both covers being arranged in said tubular housing, said spacer being also arranged inside said tubular housing, said spacer including two braces arranged on opposite sides of an axis of rotation of said driven motor, said drive motor having a return closure pipe and two permanent magnets arranged on the latter, said tubular housing being formed by said return closure pipe, said permanent magnets having ends which face toward one another and arranged at a distance from one another, said braces extending between said ends, and at least one of said braces having at least one region which is pre-stressed in a peripheral direction of said tubular housing and presses against an associated side surface of a respective one of said permanent magnets.

2. An aggregate as defined in claim 1, wherein each brace is provided with such a pre-stressed region which presses against the facing end surface of a respective one of said permanent magnets.

3. An aggregate for feeding a fuel from a supply tank to an internal combustion engine, particularly a power vehicle, comprising an electric drive motor; a feeding pump driven by said drive motor; a housing accommodating said drive motor and said feeding pump and having two openings; two covers each covering a respective one of said openings; and a spacer extending from one of said covers to another of said covers and connecting said covers with one another so as to form a one-piece integral structure, said housing being tubular, said both covers being arranged in said tubular housing, said spacer being also arranged inside said tubular housing, said tubular housing having a ring end surface, one of said covers having a radial ring projection which cooperates as an abutment with said ring surface of said tubular housing, and the other of said covers having an end surface facing away of said ring projections and provided with an elastically deformable safety element, said tubular housing having another ring end surface which is at least partially engaged by said safety element.

* * * * *